US005369966A

United States Patent [19]

Morita et al.

[11] Patent Number: 5,369,966

[45] Date of Patent: Dec. 6, 1994

[54] METHOD AND APPARATUS FOR YARN PROCESSING POSITION CONTROL OF FLAT KNITTING MACHINE

[75] Inventors: Toshiaki Morita, Kaiso; Hirokazu Nishitani, Arida, both of Japan

[73] Assignee: Shima Seiki Manufacturing Limited, Wakayama, Japan

[21] Appl. No.: 76,624

[22] Filed: Jun. 15, 1993

[30] Foreign Application Priority Data

Jun. 17, 1992 [JP] Japan ..... 4-157810

[51] Int. Cl.[5] ..... D04B 15/16; D04B 15/58; D04B 15/60

[52] U.S. Cl. ..... 66/132 R; 66/125 R; 66/127; 66/144

[58] Field of Search ..... 66/232, 126 R, 125 R, 66/144, 132 T, 132 R, 146, 143, 133, 126 A, 127, 60 R; 364/470

[56] References Cited

U.S. PATENT DOCUMENTS

| | | | |
|---|---|---|---|
| 4,628,710 | 12/1986 | Jacobsson | 66/132 R |
| 4,658,603 | 4/1987 | Stoll et al. | 66/126 R |
| 4,840,046 | 6/1989 | Goller et al. | 66/144 |
| 4,953,367 | 9/1990 | Memminger et al. | 66/132 R |
| 5,050,405 | 9/1991 | Jacobsson | 66/132 R |
| 5,056,338 | 10/1991 | Asai | 66/127 |
| 5,131,244 | 7/1992 | Plath et al. | 66/144 |

FOREIGN PATENT DOCUMENTS

| | | | |
|---|---|---|---|
| 0307769 | 3/1989 | European Pat. Off. . | |
| 0078242 | 4/1987 | Japan | 66/125 R |
| 1266252 | 10/1989 | Japan | 66/125 R |
| 2-14455 | 4/1990 | Japan . | |
| 82/03642 | 10/1982 | WIPO . | |

*Primary Examiner*—Clifford D. Crowder
*Assistant Examiner*—John J. Calvert
*Attorney, Agent, or Firm*—Wenderoth, Lind & Ponack

[57] ABSTRACT

In order to process yarn preliminarily, and to change over yarn precisely at a desired knitting position, the yarn fed to a flat knitting machine is processed by a yarn processing device. To change over the yarn at a changeover position of knitted fabric, it is necessary to actuate the yarn processing device preliminarily at an actuating position C. A controller calculates the actuating position from a set value in a setting circuit and pattern information from a memory. When an encoder detects that a position of feeding the yarn to a knitting needle has reached the actuating position, the yarn processing device is actuated. The length of the yarn from a yarn processing position to the actuating position is nearly equal to the sum of a knitting loop length from the actuating position to the changeover position.

10 Claims, 8 Drawing Sheets

METHOD AND APPARATUS FOR YARN PROCESSING POSITION CONTROL OF FLAT KNITTING MACHINE

BACKGROUND OF THE INVENTION

1. Field of the Invention

The present invention relates to a method of yarn processing position control of a flat knitting machine for processing the yarn by a knotter or the like to change over by coupling an exchange or new yarn with a yarn previously fed for knitting, to enable knitting of an intarsia pattern or the like by using the processed yarn, and to apparatus for executing such method.

2. Description of the Related Art

Hitherto, when knitting an intarsia pattern or a stripe pattern, colors are changed by coupling a new yarn to an existing yarn, during the knitting process, by a knotter provided in the knitting machine. Such prior art arrangement is disclosed, for example, in Japanese Examined Patent Publication JP-B2-1990-14455 (PCT/EP82/00083) or Japanese Unexamined Patent Publication JP-A-1988-270846 (DE-P3712264.9).

According to the prior art arrangement disclosed in Japanese 1990-14455, a stripe-like pattern with changed colors is knitted by a circular knitting machine. Knitting is done by a cylindrical rotary needle, and a drum is provided between a knotter and a cylinder in order to retain yarn at an intermediate position. The peripheral length of the cylinder is constant, and the required length of the yarn is determined by the product of this length and the number of stages for knitting the strip-like pattern. The knotter changes over the yarn when feeding the yarn by this length. While the knotter is working to change over yarn, the yarn preliminarily retained in the drum is fed to the cylinder, so that the knitting operation does not stop.

According to the prior art arrangement disclosed in 1988-270846, by splicing the yarn while knitting by a flat knitting machine, patterns of changed colors are knitted. Where yarn splicing is desired, the knitting machine is stopped, and the yarn is spliced at a position upstream of a knitting needle. Yarn from the position of the yarn being fed to the knitting needle to a position exceeding the coupling point is drawn into a yarn drawing device provided at one end of the needle bed. The drawn yarn is confined, and the knitting machine is started again to resume knitting, and the drawn portion of the yarn then is cut off.

According to the above-mentioned prior art arrangements, within one knitting course of fabric, a stripe-like pattern without yarn changeover can be favorably knitted. However, various problems occur when knitting an intarsia pattern fabric 1 as shown in FIG. 10. In the intarsia pattern fabric 1, plural colors are used in one knitting course in the horizontal direction in FIG. 10. In the lower knitting course, there exist white yarn fabric 2, red yarn fabric 3, and yellow yarn fabric 4. In the upper knitting course, there exist white yarn fabric 2, blue yarn fabric 5, and yellow yarn fabric 4. In the prior art arrangement disclosed in Japanese 1990-14455, although knitting of a stripe-like pattern is possible, intarsia pattern fabric 1 cannot be knitted. In the prior art arrangement disclosed in Japanese 1988-270846, the knitting operation must be stopped when changing over the yarns of various colors, and the yarn must be drawn out and spliced.

When knitting the intarsia pattern fabric 1 shown in FIG. 10, if using different yarn feeders for each color, problems when changing over the yarns do not occur. In such case, to knit the intarsia pattern fabric 1, yarn feeders for four colors must be prepared. However, since the red yarn and blue yarn are not knitted simultaneously, by coupling the red yarn and blue yarn in one yarn feeder, it is possible to knit by using three yarn feeders in total. This concept can be employed when using more color yarns. In order that coupling is at the changeover position of the red yarn fabric 3 and blue yarn fabric 5, the knitting operation of the knitting machine may be stopped at that position, and the yarns may be changed over as in the prior art arrangement disclosed in Japanese 1988-270846. However, when drawing out and processing the yarn, the knitting operation must be stopped, and the cut portion of the yarn is wasted. Moreover, since a yarn drawing device is needed, the construction of the apparatus and the control for the apparatus are complicated.

SUMMARY OF THE INVENTION

It is hence a primary object of the invention to provide a method and an apparatus for yarn processing position control of a flat knitting machine, wherein it is possible to change over the character of yarn accurately at a knitting position, such that a preprocessed yarn is changed to a processed yarn supply thereof to the knitting position.

It is a further object of the invention to provide such a method and an apparatus whereby it is possible to change the character of yarn without providing an additional specialized device.

The invention provides a method of yarn processing position control for a flat knitting machine, which forms a pattern by preliminarily processing the yarn to be fed to the flat knitting machine and changes the character of the yarn to knit a fabric, characterized by the steps:

preliminarily setting a yarn length AB of yarn required from a processing position A at which processing of the yarn occurs to a predetermined reference position B, and a yarn length Li required for each loop formed during a knitting operation;

determining a changeover position D on the fabric being knitted for changing over knitting yarn to after-processed yarn from pattern information for each loop to be knitted;

summing up the consumed yarn length Li of each loop from the changeover position D in an order reverse to the knitting order to determine a sum S;

finding an actuating position C for feeding the yarn to a knitting needle when the sum S satisfies the condition of $$AB+BC \leqq S \quad (1)$$

wherein BC equals the length from the reference position B to the actuating position C for feeding yarn to the knitting needle;

detecting the yarn feeding position at which the knitting yarn is fed to the knitting needle after start of a knitting operation; and processing the yarn at the processing position A when the yarn feeding position reaches the actuating position C.

In the invention, the actuating position C is determined as a position of feeding yarn to the knitting needle when the following condition is satisfied, $$AB+BC \leqq S+\alpha \quad (2)$$

so that unprocessed yarn that remains after knitting to changeover position D will be not more than a predetermined length $\alpha$, and the yarn of the length $\alpha$ being drawn out by a knitting needle at the changeover position D.

The invention also provides an apparatus for yarn processing position control of a flat knitting machine so as to change over the character of the yarn to knit a fabric after preliminarily processing the yarn to be fed to the flat knitting machine by a yarn processor, comprising:

a setting device to preliminarily set a yarn length AB required from a processing position A of the yarn processor to a predetermined reference position B, and yarn length Li required for each loop formed during a knitting operation;

a memory to store pattern information of fabric to be knitted in every loop;

a calculator to determine a sum S of the yarn lengths Li consumed by every loop from a changeover position D on the fabric for changing over knitting yarn to thread after-processed yarn in a direction reverse to the knitting loop order, according to information stored in the memory, and to calculate an actuating position C as a position to feed yarn to a knitting needle when the sum S satisfies the condition of $$AB+BC \leqq S \quad (3)$$

in terms of the preliminarily set yarn length AB and in terms of yarn length BC required from the reference position B to the actuating position C to the knitting needle;

a detector to detect the yarn feeding position which is the position of the knitting needle in the knitting operation; and a control to, in response to outputs from the calculator and the detector, control the yarn processor so that the yarn being processed by the yarn processor during a knitting operation reaches the actuating position C.

In the invention, the calculator calculates the actuating position C as a position of feeding yarn to the knitting needle in the condition of $$AB+BC \leqq S+\alpha \quad (4)$$

so that unprocessed yarn remains after knitting to changeover position D will be not more than a predetermined length $\alpha$; and the control controls the knitting operation of the knitting needle to draw out yarn of the length not more than $\alpha$ after knitting up to the changeover position.

The invention moreover provides an apparatus for yarn processing position control of a flat knitting machine so as to change over the character of the yarn for knitting a fabric by preliminarily processing the yarn to be fed to the flat knitting machine by a yarn processor, comprising:

an operating input to enter an actuating position C, which is the position of feeding yarn to the knitting needle at a point to change over the knitting yarn to after-processed yarn, and position D at which the character of yarn of the fabric is changed over; and a control, operable in response to the input to the operating input, to control the flat knitting machine so as to start processing yarn by the yarn processor when the position of feeding yarn reaches the actuating position C during a knitting operation, and so as to draw out yarn of a predetermined length $\alpha$ by operation of the knitting needle when the yarn feeding position during the knitting operation reaches the changeover position D.

According to the invention, the yarn length AB required from the processing position A for processing the yarn to the predetermined reference position B, and the yarn length Li consumed by every loop during a knitting operation, such as knitting, tucking and missing, are set preliminarily. From the pattern information of every loop to be knitted, the changeover position D on the fabric for changing over the knitting yarn to the after-processed is determined, and the yarn length Li consumed by every loop is added reversely to the order of knitting from the changeover position D, and the sum S is calculated. The actuating position C is determined as the yarn feeding position, supposing the length of the yarn required from the reference position B to the yarn feeding position for the knitting needle as BC, when the following relation $$AB+BC \leqq S \quad (5)$$

is satisfied. After start of a knitting operation, the position of the knitting needle to which the yarn is supplied is detected. When the yarn feeding position reaches the actuating position C, the yarn is processed at the processing position A. In the process of summing the consumed yarn length Li reversely to the order of knitting from the changeover position D, initially the sum S is shorter than the length (AB+BC) of the yarn from the yarn feeding position for the knitting needle to the processing position A. The length of AB is constant, and the length of BC varies with the yarn feeding position. When the condition in formula (5) is satisfied for the first time, the yarn at the processing position A is processed. Therefore, after further continuation of knitting up to the changeover position D, the processed portion of the yarn preliminarily processed at the actuating position C is fed to the knitting needle. Knitting after changeover position D is performed by using the yarn that was changed in character by the processing operation. Therefore, the required number of yarn feeders does not increase if plural yarns are used.

In a preferred embodiment of the invention, the yarn is processed at the actuating position C satisfying the relation of $$AB+BC \leqq S+\alpha \quad (6)$$

when the unprocessed yarn left at the changeover position D is not more than the predetermined length $\alpha$. At the changeover position D, the yarn of the length $\alpha$ is drawn out by operation of a knitting needle. When the length $\alpha$ is determined, for example, at more than the maximum error that may occur when summing the consumed yarn lengths Li, the yarn being drawn out always includes a processed portion, and therefore knitting after the changeover position D will be done by use of the changed yarn. As a result, the yarn will be changed over accurately.

According to the invention, moreover, the yarn to be fed to the flat knitting machine is preliminarily processed by the yarn processor, and the character of the yarn for knitting the fabric is changed. The device for controlling the yarn processing position includes a setting device, a memory, a calculator, a detector and a control. In the setting device or set or input, the length AB of the yarn from the processing position A at the yarn processor to the predetermined reference position B, and the yarn length Li required by each loop during a planned knitting operation, such as knitting, tucking and missing, are set or input. In the memory is stored pattern information of the fabric to be knitted for every loop. The calculator sums the consumed yarn length Li input for each loop from the changeover position D on the fabric for changing over the knitting yarn to the after-processed yarn. When the sum S satisfies the relation of $$AB+BC \leqq S \tag{7}$$

in terms of the set yarn length AB and the yarn length BC required from the reference position B to the yarn feeding position for the knitting needle, the yarn feeding position to the knitting needle is calculated as the actuating position C. The detector detects the knitting needle position during the knitting operation. The control actuates the yarn processor to process the yarn when the yarn feeding position reaches the actuating position C during a knitting operation, in response to outputs from the calculator and detector. The sum S and the yarn length from the yarn processing position A to the actuating position B become equal to each other, and therefore change of the character of the yarn occurs accurately at the changeover position D.

In other preferred embodiment of the invention, the yarn is processed at the actuating position C when unprocessed yarn of not more than the predetermined length $\alpha$ remains at the changeover position D and the relation of $$AB+BC \leqq S+\alpha \tag{8}$$

is satisfied. The yarn of the length $\alpha$ is drawn out at the changeover position D by the operation of the knitting needle. For such operation, for example, adjacent needles may be used if they are not in operation. When the length $\alpha$ is determined to be greater than a maximum error when adding the consumed yarn length Li, the yarn being drawn out always includes the processed portion, so that the yarn is able to be changed over accurately.

According also to the invention, the actuating position C and changeover position D are entered in an operator. The control operates to start processing of yarn by the yarn processor when the yarn feeding position reaches the actuating position C during a knitting operation, and to draw out the yarn of the predetermined length $\alpha$ by the operation of a knitting needle when the yarn feeding position reaches the changeover position D. The actuating position C is entered as the position where a length of unprocessed yarn not more than $\alpha$ when the yarn feeding position reaches the changeover position. The yarn thus is changed over accurately at the changeover position D.

Thus, in the invention, since processing of yarn is started when the sum S of the consumed yarn length from the changeover position D to the actuating position C is more than the yarn length from the yarn processing position A to the actuating position C, the character of yarn is changed over accurately when the fabric knitted by the fed yarn reaches the changeover position D. Hence, using only few yarn feeders, it is possible to change over and use many types of yarns.

The invention allows accurate changeover of the character of yarn at the changeover position D on the fabric. Yarn of the length $\alpha$ is drawn out by the knitting operation of the knitting needle, and therefore no additional yarn drawing out device is required. As knitting operations, there are possibilities of a tuck operation to be fed with the yarn to the hook of the needle and of a knit operation to be fed with yarn over already fed yarn. Moreover, it is possible to feed yarn on the back of the needle, or to bury the drawn out yarn under transferred loop after a transfer operation.

According to the invention, when the yarn is processed by the yarn processor at the moment the knitting needle reaches the actuating position C during knitting, the character of yarn can be changed over securely when the knitting of the fabric reaches the changeover position D. As a result, using few yarn feeders, many yarns can be changed over and used, so that a variety of fabrics can be knitted.

Furthermore in the invention, at the changeover position D on the fabric determined from the pattern information to be knitted, yarn of the predetermined length $\alpha$ can be drawn out by the knitting operation of the knitting needle, so that the yarns may be changed over accurately.

Also according to the invention, when the actuating position C and the changeover position D are entered in the operator, the control changes over the character of yarn at the actuating position C, and this is controlled so that yarn of the length $\alpha$ is drawn out by the knitting operation of the knitting needle at the changeover position D. By setting the actuating position C so that the length of the unprocessed yarn will be $\alpha$ or less when the knitting operation reaches the changeover position D, accurate changeover of yarn is achieved.

BRIEF DESCRIPTION OF THE DRAWINGS

Other and further objects, features and advantages of the invention will be made more explicit from the following detailed description taken with reference to the drawings wherein.

DETAILED DESCRIPTION OF THE PREFERRED EMBODIMENTS

Figure 1:
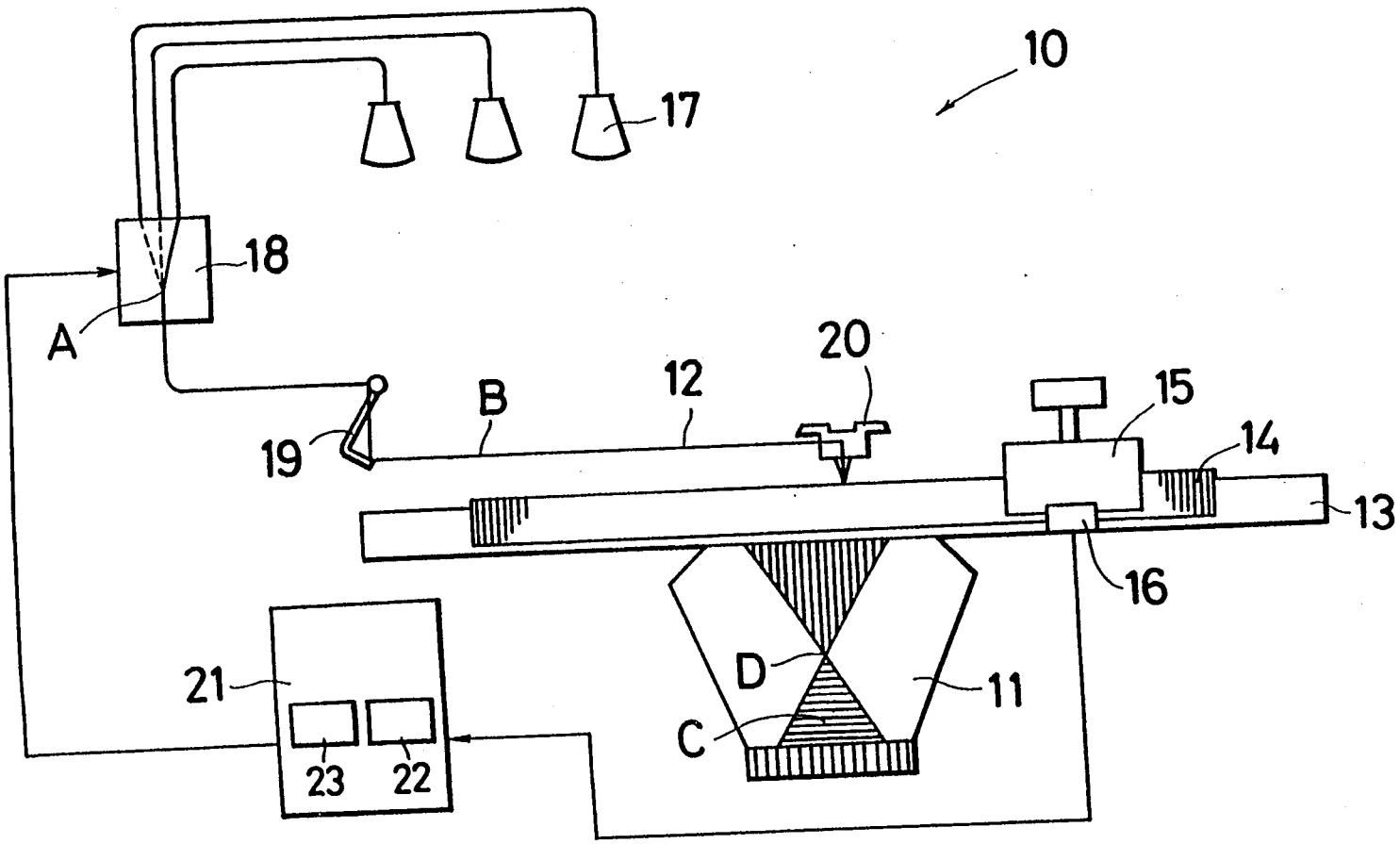
FIG. 1 is a front view showing a schematic constitution of an embodiment of the invention.

Now referring to the drawings, preferred embodiments of the invention are described below.

FIG. 1 is a schematic view of an embodiment of the invention. A flat knitting machine 10 knits a fabric 11 from yarn 12. Knitting is effected by reciprocating motion of a carriage 15, in lateral directions in FIG. 1, on a needle bed 14 disposed on a frame 13. The position of the carriage 15 is detected by an encoder 16.

The yarn 12 is supplied from plural cones 17 disposed above the needle bed 14. Plural yarns supplied from the cones are processed by a yarn processing device 18 such as a knotter and splicer, and are changed relative to their character or properties, such as color and thickness. The knotter is a device for binding and coupling different yarns. The splicer is a device for twisting different yarns end to end together for linking without forming a knot. The yarn drawn out from the yarn processing device 18 is provided with tension by a yarn tension device 19, and is supplied for knitting through a yarn feeder 20.

The control of knitting the fabric 11 by the flat knitting machine 10 is executed by a controller 21. The controller 21 comprises a setting circuit 22 for presetting a yarn length AB required between a yarn processing position A and a reference position B which is set at one end of the needle bed 14, and a yarn length Li consumed by each loop during knitting, and corresponding to control information containing stitch density and type of knitting operation, such as knitting, tucking and missing, and a memory 23 for storing knitting pattern information for each loop. The controller 21 controls the carriage 15 according to data stored in the memory 23, and controls knitting of the fabric 11. To change over the yarn 12 as a changeover position D of the fabric 11, it is necessary to actuate the yarn processing device 18 at an actuating position C prior to the changeover position D. The controller 21 calculates the actuating position C according to values set in the setting circuit 22 and data stored in the memory 23, and controls device 18 to change over the yarn when the position of feeding yarn to the knitting needle by yarn feeder 20, determined from the position of the carriage 15 detected by the encoder 16, reaches the actuating position C.

Figure 2:
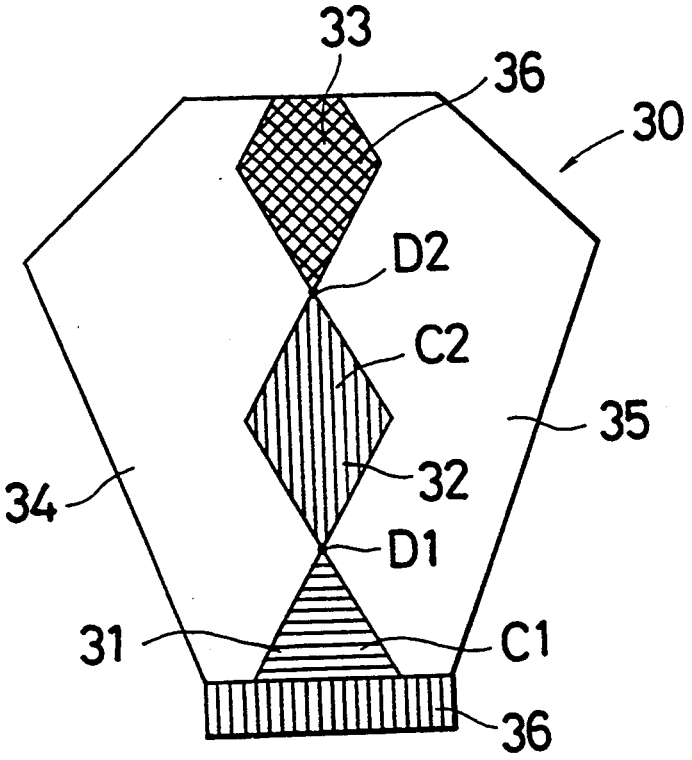
FIG. 2 is a front view of an intarsia pattern fabric that can be knitted by the embodiment shown in FIG. 1.

FIG. 2 shows an intarsia pattern fabric 30 knitted by the arrangement shown in FIG. 1. The intarsia pattern 30 comprises a first color yarn fabric 31, a second color yarn fabric 32, and a third color yarn fabric 33. These fabrics 31, 32, 33 are knitted during different knitting courses, relative to the horizontal direction, and are changed over at changeover positions D1 and D2. As a result, the first color yarn fabric 1, second color yarn fabric 32, and third color yarn fabric 33 can be knitted by using a Same yarn feeder 20. Two more yarn feeders 20 are used for knitting fourth color yarn fabric 34 and fifth color yarn fabric 35. Thus, the entire intarsia pattern fabric 30 can be knitted by a total of three yarn feeders. A rib stitch 36 is knitted in any color. If different yarn feeders 20 were used for all colors, five yarn feeders 20 would be required. To change over the colors at changeover positions D1, D2, the yarn is processed by the yarn processing device 18 in FIG. 1 when the knitting needle reaches actuating positions C1, C2.

Figure 3:
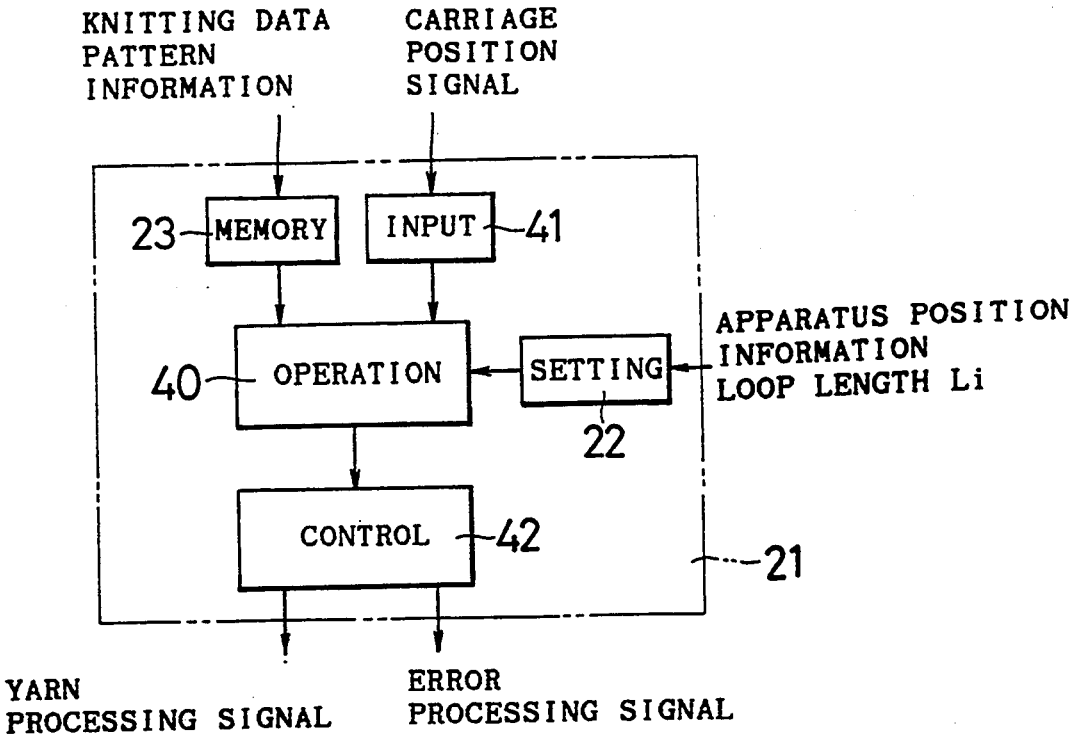
FIG. 3 is a block diagram showing constitution of a controller shown in FIG. 1.

FIG. 3 shows the constitution of the controller 21 shown in FIG. 1. The controller 21 comprises, aside from the setting circuit 22 and memory 23, an operation circuit 40, an input circuit 41, and a control circuit 42. In the setting circuit 22 are input position information of devices and loop length Li as consumed yarn length. If knitting includes missing a stitch, an actual loop is not formed, but its yarn length is also input as a loop length for the sake of convenience. In the memory 23 are stored knitting data and pattern information. The carriage position signal from the encoder 16 shown in FIG. 1 is input to the input circuit 41. The operation circuit 40, which may be a microcomputer or similar device, outputs a yarn processing signal to the yarn processing device 18 when the carriage reaches actuating position C, in response to outputs from the memory 23 and input circuit 41. Circuit 40 also can issue a signal representative of an extra length of yarn at changeover position D, such that knitting will be conducted so as to absorb such extra length or error.

Figure 4:
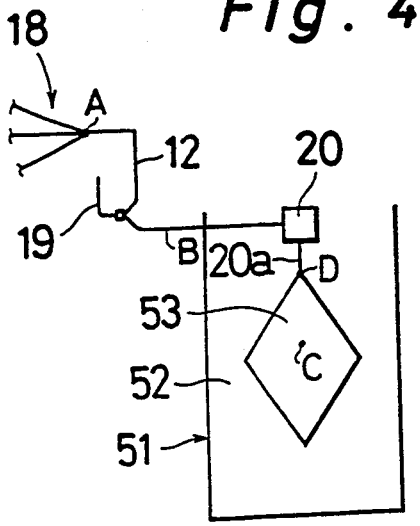
FIG. 4 is a schematic front view showing processing of yarn in the embodiment in FIG. 1.
Figure 5:
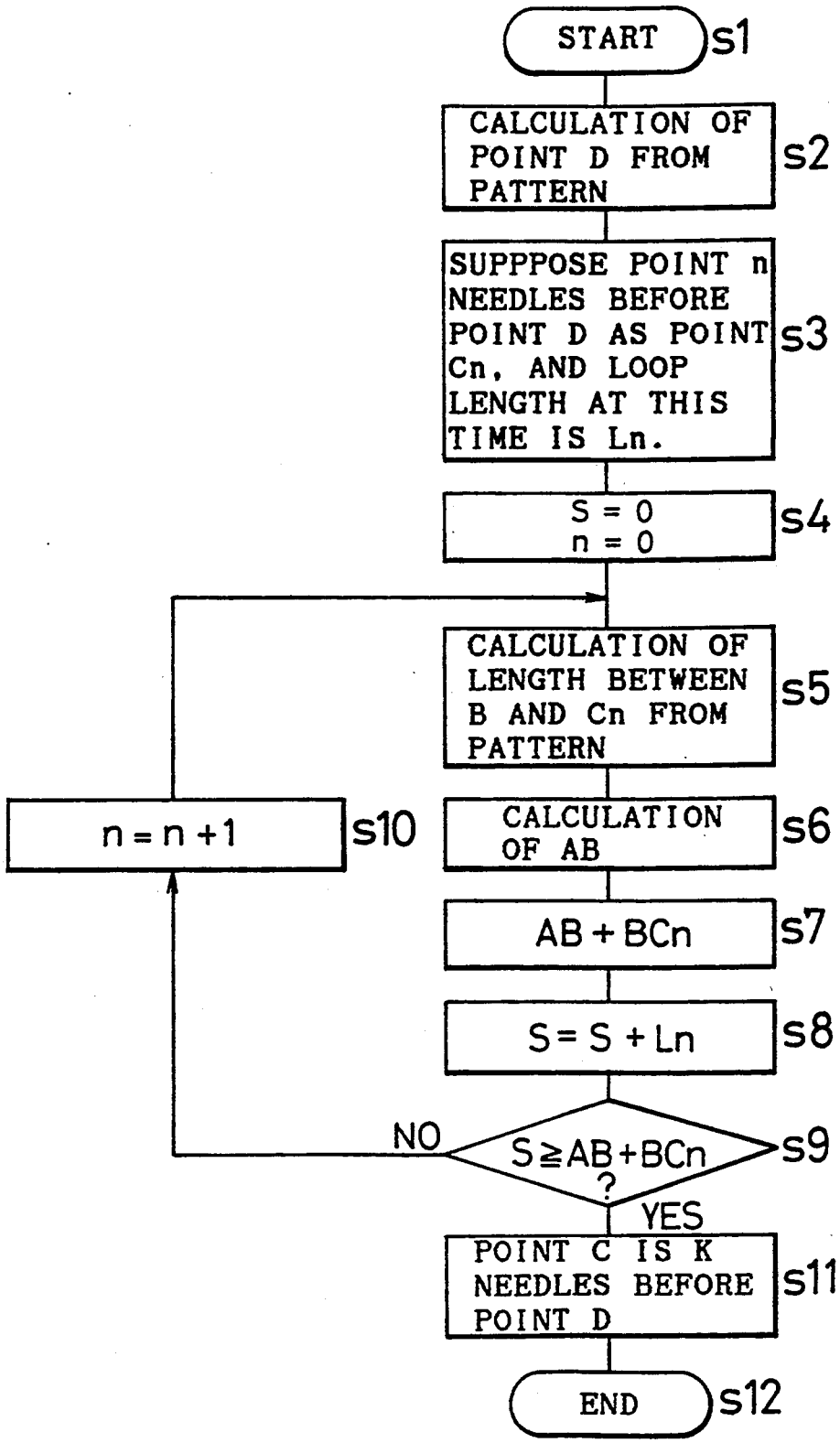
FIG. 5 is a flow chart of processing in the embodiment of FIG. 1.

FIG. 4 and FIG. 5 respectively show configuration and processing when changing over yarns for an intarsia pattern fabric 51. In FIG. 4, the intarsia pattern fabric 51 is composed of base fabric 52 and pattern 43, which are knitted by different yarns from different yarn feeders 20. When the front end of knitting needle 20*a* knitting the pattern 53 reaches changeover position D, the yarn fed from the yarn feeder 20 is changed over to yarn processed by the yarn processing device 18. For this purpose, when knitting reaches or occurs at the actuating position C, it is necessary to change over the yarn preliminarily at the processing position A. When the pattern 53 is small, the actuating position C may be outside of the pattern 53. The reference position B is, for example, the left end of the needle bed 14 as shown in FIG. 1.

In FIG. 5, by setting the reference position B on the basis of the pattern information and knitting data, processing is started from step s1. At step s2, point D or the changeover position is calculated form the pattern information. To knit pattern 53 to point D, a point, in a direction reverse to the direction of actual knitting, knitted by the knitting needle n needles before point D is point Cn. Supposing the yarn length consumed corresponding to the knitting operation and loops at point Cn to be loop length Ln, the loop length data preset in the setting circuit 22 is referred to. At step s4, the sum S of length and parameter n are initialized t zero.

At step s5, using the pattern information, the length of the yarn required from the reference position B to the point Cn is calculated. At step s6, the length AB of the yarn required from the yarn processing position A to the reference position B among set values is calculated. At step s7, AB and BCn are summed. At step s8, the value of Ln is added to S. At step s9, it is judged whether or not the relationship of formula (9) is satisfied.

$$S \leqq AB + BCn \tag{9}$$

If the condition is not satisfied at step s9, the operation goes to step s10 and then returns to step s5. At step s10, the value of n is increased by an increment of 1 only. In this way, when step s5 to step s9 are repeated, the value of n is increased by an increment of 1 each time, and thus is further spaced from the changeover position D in a direction reverse to the direction of actual knitting. When the condition of step s9 is satisfied, going to step s11, the actuating position C is advanced from the changeover position D by K which is the value of the parameter n at that time, and processing is terminated at step s12. Incidentally, K is the minimum value of n for satisfying formula (9). Since the value of AB is constant, step s6 can be omitted by calculating it at step s1.

Figure 6:
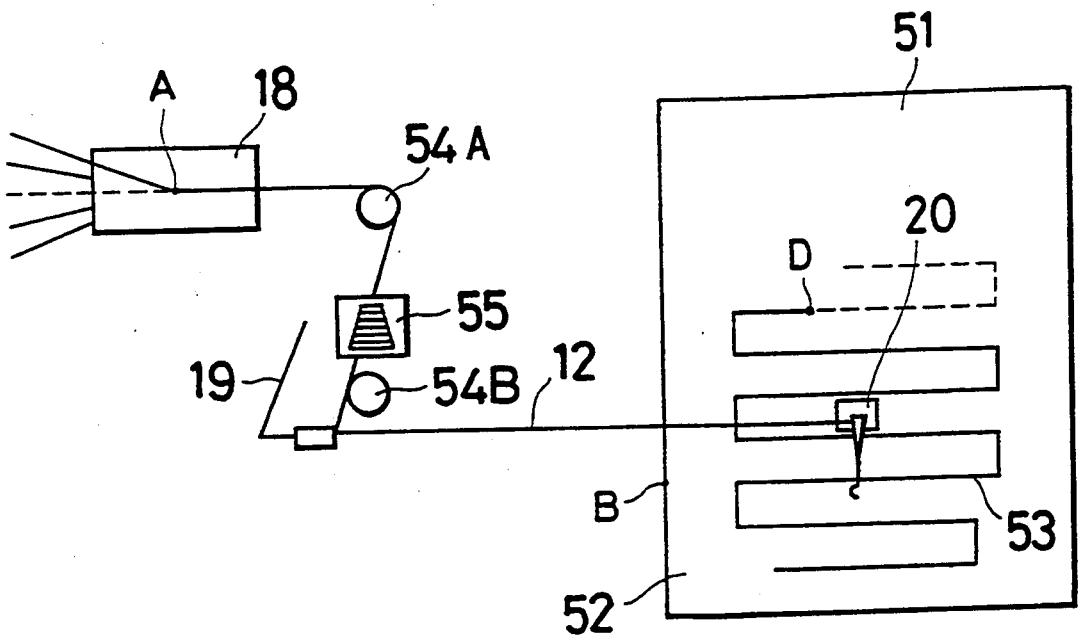
FIG. 6 is a front view showing a schematic constitution of another embodiment of the invention.

FIG. 6 shows the constitution of another embodiment of the invention. This embodiment is similar to the embodiment in FIG. 1, and corresponding parts are identified with the same reference numbers. What should be noted here is that a first yarn length measuring device 54A, a yarn pool 55, and a second yarn length measuring device 54B are provided between the yarn processing device 18 and yarn tension device 19. The yarn length measuring devices 54A, 54B detect the lengths of yarn supplied by outputs from rotary encoders, which are attached to rollers dislocated angularly as the yarn 12 is supplied respectively from the yarn processing device 18 and yarn pool 55. The yarn pool 55 retains yarn of a length corresponding to the difference of measurements by the yarn length measuring devices 54A and 54B, and feeds the retained yarn 12 to the yarn feeder 20 when yarn is to be processed by actuating the yarn processing device 18.

Figure 7:
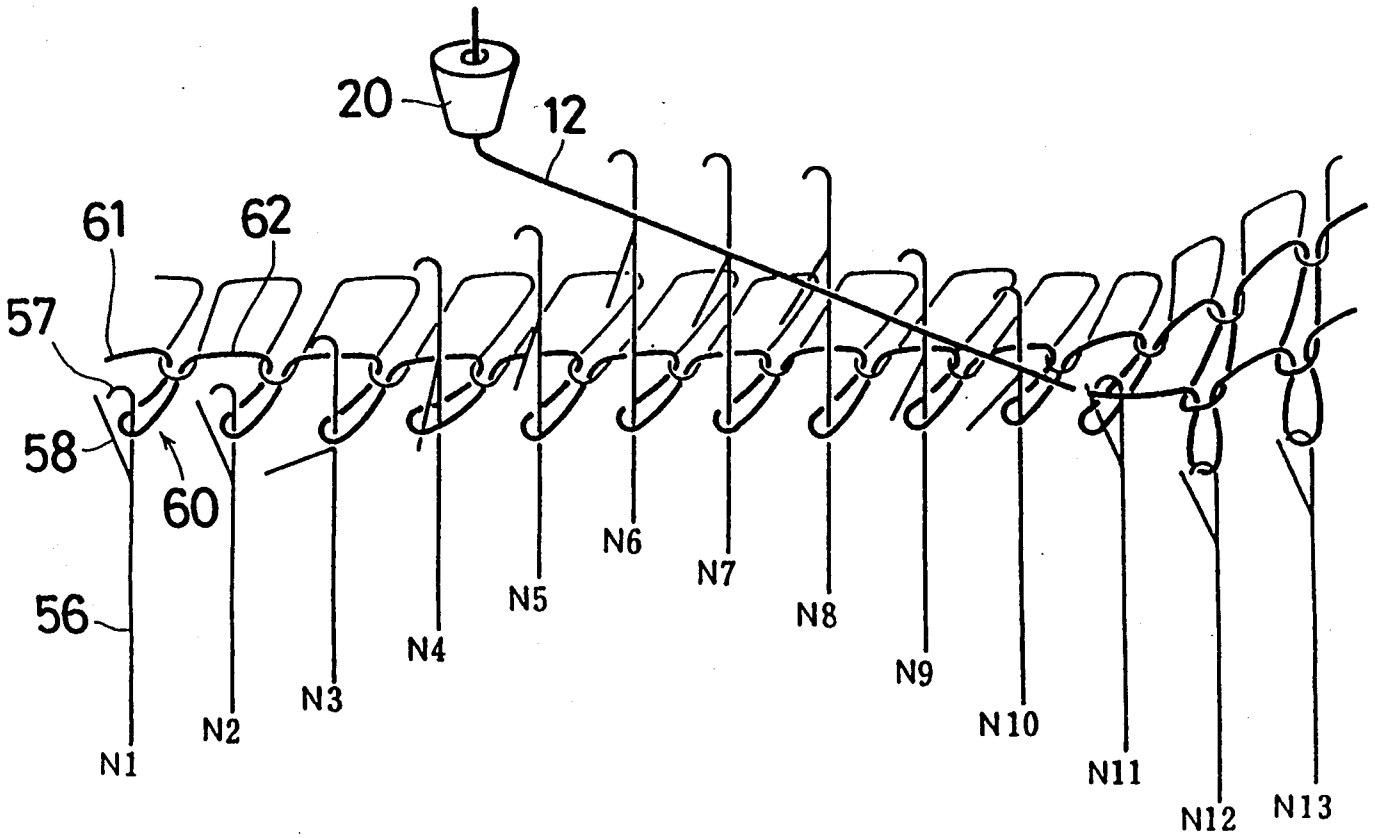
FIG. 7 is a schematic perspective view showing a knitting operation of a flat knitting machine.

FIG. 7 shows a knitting operation in the flat knitting machine. A knitting needle 56 dislocating along a needle groove of the needle bed is moved by a cam device in the carriage, and is dislocated as indicated by N1 to N13. A hook 57 is formed at the front end of the knitting needle 56, and is opened or closed by a latch 58. A loop 60 being formed of the yarn 12 fed from the yarn feeder 20 possesses a loop length from loop end 61 to loop end 62 for each loop. This loop length is determined by the amount of drawing by the knitting needle into the state of N12 or the like.

Figure 8:
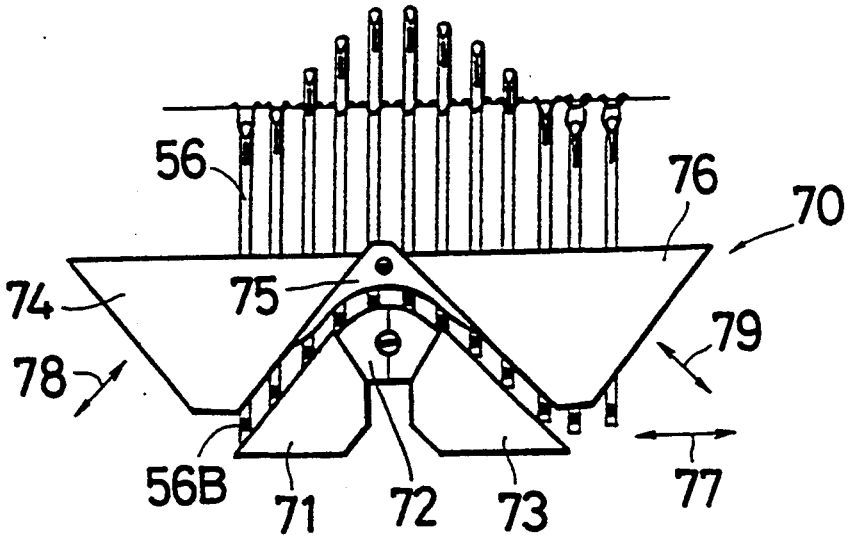
FIG. 8 is a diagram showing operation of a cam device in a flat knitting machine.

FIG. 8 shows a cam device 70 disposed on the carriage for knitting by the knitting needle 56. The cam device 70 comprises an inclined cam 71, a center cam 72, an inclined cam 73, a knitting cam 74, guard cam 75, and a knitting cam 76. Cam device 70 causes an end or tab 56B of the knitting needle 56 to be moved up and down. The inclined cams 71, 73 and knitting cams 74, 76 are provided in right and left pairs, and they achieve needle movement as the carriage moves in the directions shown by arrow 77. When the carriage advances to the left in FIG. 8, the knitting needle 56 is moved up by the cam 71, and is moved down by the knitting cam 76. The knitting cams 74, 76 can be dislocated in stitch density adjusting directions indicated by arrows 78, 79, respectively, and stitch density is adjusted depending on the extent of pull-down of the knitting needle 56. This stitch density adjustment may be remote-controlled by a pulse motor.

Since the loop length can be changed by the stitch density adjustment of the knitting cams 74, 76, and if the length of the yarn 12 measured by the yarn length measuring devices 54A, 54B and the theoretical value which is the sum S calculated from the pattern information are different, the stitch density of the knitting cams 74, 76 may be adjusted and corrected.

Figure 9:
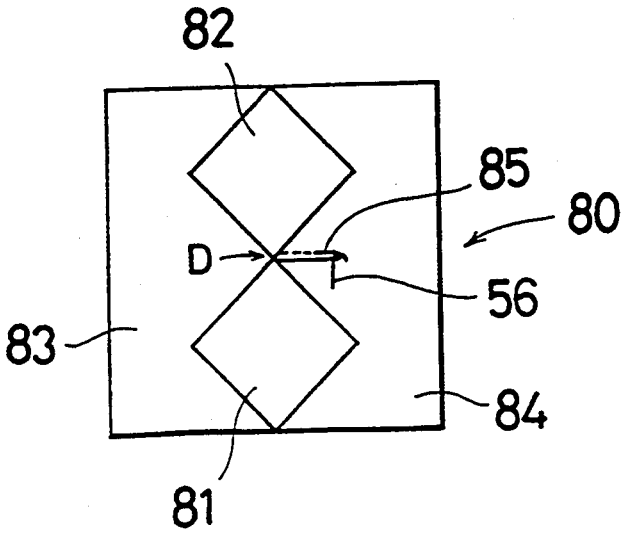
FIG. 9 is a diagram showing an error absorbing operation in a further different embodiment of the invention.
Figure 10:
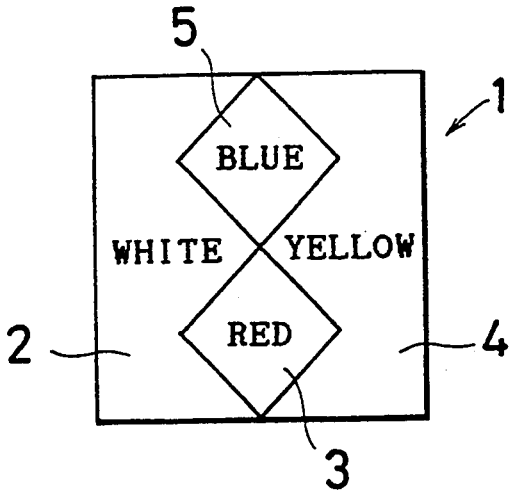
FIG. 10 is a diagram showing an example of intarsia pattern fabric.

FIG. 9 shows a further different embodiment of the invention. An intarsia pattern fabric 80 is knitted of four patterns 81, 82, 83, 84. The pattern 81 and pattern 82 are knitted by changing over the yarns at point D. At point D, preliminarily considering the maximum value of error, an unprocessed yarn of a length of $\alpha$ or less is left over or remains unknitted. Various methods for processing this yarn of length $\alpha$ can be provided. An example is to use a knitting needle 56 which is not used in design knitting, e.g. of pattern 81, to detach such length after knitting of the course, or by knitting and processing by tucking the knitting needle in the midst of use in design knitting. Thereby, the error portion, including a knot 85 formed in processing portion 18 in the fabric 80, may be absorbed. When the length $\alpha$ corresponds to the distance k needles, the error of length $\alpha$ can be absorbed by using the needle k/2 spaced from the position D. At this time, the knot 85 is knitted into the loop so as to not be visible from the outside of the knitted product. Such knitting process may be prepared as a sub-routine of the controller 21 shown in FIG. 1, and may be selected depending on the pattern to be knitted. In this embodiment, instead of formula (9), the yarn is processed at the actuating position C where the following formula (10) is satisfied.

$$S+\alpha \leqq AB+BCn \tag{10}$$

Even in a flat knitting machine not provided with full functions of the controller 21 shown in FIG. 3, accurate yarn changeover is possible if the controller has the functions of input circuit 41 for operating and entering the actuating position C and changeover position D, and control circuit 42 for controlling change over of the yarn in response to the input circuit 41. That is, at the changeover position D, yarn of length $\alpha$ is drawn out and processed by the knitting operation of the knitting needle as mentioned above. The actuating position C is determined, for example, (1) by calculating with the aid of a CAD system or the like other than the knitting machine, (2) by an operator calculating the loop length on the basis of the knitting design, or (3) by making a trial knitting operation without calculating and predicting by observing the location of the knitted portion. Taking errors into account, when designed to leave unprocessed yarn of a length of only $\alpha$ or less at the changeover position D, an accurate yarn changeover operation is enabled.

In the foregoing embodiments, different color yarns are tied or spliced by using a knotter or splicer as the yarn processing device 18. However, the invention similarly may be employed for other operations, such as a change of property of the same color yarn.

Moreover, the knitting pattern is not limited only to the intarsia pattern, but also may be employed for a stripe pattern or the like, whenever the yarn must be changed with regard to color or the like or other property changes. A needle to use for processing the above-mentioned yarn of length $\alpha$ is available, if such needle is not used for knitting within the width of the fabric in which a knitting pattern exists inside the fabric, such as the diamond shape of the intarsia pattern. A plurality of needles also may be used. Further, methods other than using needles for pattern knitting are possible, for example, such as tucking. It is possible to use needles existing outside the fabric width when the knitting pattern is formed over the entire fabric width, as in stripe patterns.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and the range of equivalency of the claims are therefore intended to be embraced therein.

What is claimed is:

1. A method of control of a yarn processing operation, during which yarn supplied to a flat knitting machine is changed from a preprocessed yarn to a processed yarn, thereby to enable knitting of a patterned fabric by said flat knitting machine, said method comprising:

preliminarily establishing a yarn length AB from a processing position A, whereat said yarn processing operation occurs, to a predetermined reference position B;

preliminarily establishing a yarn length Li consumed by each loop formed during knitting by said flat knitting machine;

determining, in accordance with pattern information for each knitted loop to form the patterned fabric, a changeover position D on the fabric at which the yarn of the fabric is to change from preprocessed yarn to processed yarn;

detecting, after commencement of knitting, a yarn feeding position at which preprocessed yarn is fed to a knitting needle of said flat knitting machine to form each knitted loop of said fabric;

summing, in a direction reverse to the direction of knitting of said fabric, a sum S of yarn lengths Li of loops to be knitted by said flat knitting machine to said changeover position D;

determining an actuating position C at which said sum S satisfies the condition;

$$AB+BC \leqq S$$

wherein BC equals a yarn length from said reference position B to said actuating position C; and conducting said yarn processing operation at said processing position A when said yarn feeding position reaches a said actuating position C.

2. A method as claimed in claim 1, comprising determining said actuating position C when:

$$AB+BC \leqq S+\alpha$$

wherein $\alpha$ equals a predetermined maximum length of preprocessed yarn remaining when knitting is achieved to said changeover position D;

and further comprising drawing out remaining preprocessed yarn at said changeover position D by operation of a knitting needle of said flat knitting machine.

3. A method as claimed in claim 1, wherein said processing operation comprises knotting said processed yarn to said preprocessed yarn.

4. A method as claimed in claim 1, wherein said processing operation comprises splicing said processed yarn to said preprocessed yarn.

5. A method as claimed in claim 1, further comprising measuring by measuring means the length of preprocessed yarn, and if such thereby measured length differs from said sum S, adjusting a cam that controls said yarn length Li to decrease a difference between said measured length and said sum S.

6. An apparatus for controlling operation of a yarn processing device, by which yarn supplied to a flat knitting machine is changed from a preprocessed yarn to a processed yarn, thereby to enable knitting of a patterned fabric by the flat knitting machine, said apparatus comprising:

setting means for preliminarily establishing a yarn length AB from a processing position A, at which said yarn processing device changes the yarn, to a predetermined reference position B, and a yarn length Li consumed by each loop formed during knitting by the flat knitting machine;

a memory storing pattern information for each knitted loop to form the patterned fabric;

detecting means for detecting, after commencement of knitting, a yarn feeding position at which preprocessed yarn is fed to a knitting needle of the flat knitting machine to form each knitted loop of the fabric;

calculating means for, in response to said pattern information in said memory and to said yarn lengths established by said setting means, summing, in a direction reverse to the direction of knitting of the fabric, a sum S of said yarn lengths Li to be knitted by the knitting machine to a changeover position D on the fabric at which the yarn of the fabric is to change from preprocessed yarn to processed yarn, and for calculating an actuating position C at which said sum S satisfies the condition:

$$AB+BC \leqq S$$

wherein BC equals a yarn length from said reference position B to said actuating position C; and control means for, in response to outputs from said detecting means and said calculating means, operating said yarn processing device to change to processed yarn at said processing position A when said yarn feeding position reaches a said actuating position C.

7. An apparatus as claimed in claim 6, wherein said calculating means calculates said actuating position C when:

$$AB+BC \leqq S+\alpha$$

wherein $\alpha$ equals a predetermined maximum length of preprocessed yarn remaining when knitting is achieved to said changeover position D; and said control means controls a knitting needle of the flat knitting machine to draw out preprocessed yarn remaining at said changeover position D.

8. An apparatus as claimed in claim 6, wherein said yarn processing device is operable to knot the processed yarn to the preprocessed yarn.

9. An apparatus as claimed in claim 6, wherein said yarn processing device is operable to splice the processed yarn to the preprocessed yarn.

10. An apparatus for controlling operation of a yarn processing device, by which yarn supplied to a flat knitting machine is changed from a preprocessed yarn to a processed yarn, thereby to enabling knitting of a patterned fabric by the flat knitting machine, said apparatus comprising:

input means operable to receive an input representative of a changeover position, at which yarn of fabric being knitted is to change from preprocessed yarn to processed yarn, and to receive an input representative of an actuating position, corresponding to a timing point at which said yarn processing device is to be operated to ensure that processed yarn is supplied at said changeover position; and control means for, in response to said inputs to said input means, controlling operation of the flat knitting machine to operate said yarn processing device to change to processed yarn when a yarn feeding position at which yarn is fed to a knitting needle of the flat knitting machine reaches said actuating position, and to, when knitting is achieved to said changeover position, operate a knitting needle of the flat knitting machine to draw out yarn of a length no greater than a predetermined length.

* * * * *